United States Patent [19]

Conway

[11] 4,439,177

[45] Mar. 27, 1984

[54] ROTOR BUCKET LINER

[75] Inventor: George E. Conway, Newark, Calif.

[73] Assignee: Beckman Instruments, Inc., Fullerton, Calif.

[21] Appl. No.: 315,091

[22] Filed: Oct. 26, 1981

[51] Int. Cl.[3] ..... B04B 15/02

[52] U.S. Cl. ..... 494/20; 220/409; 220/410; 494/45

[58] Field of Search ..... 233/1 A, 1 E, 27, 28, 233/26, 32, 33, 44; 220/94 R, 410, 408, 409; 206/804; 604/403, 4; 128/760, 762, 767; 494/16, 20, 45

[56] References Cited

U.S. PATENT DOCUMENTS

| | | | |
|---|---|---|---|
| 1,980,715 | 11/1934 | Brosler | 220/409 X |
| 2,780,225 | 2/1957 | Barr et al. | 604/403 |
| 3,211,368 | 10/1965 | Shanley | 233/26 X |
| 3,401,535 | 9/1968 | Palmer | 220/410 X |
| 3,561,672 | 2/1971 | Schlutz | 233/17 |
| 3,621,994 | 11/1971 | Brown | 220/410 X |
| 3,743,174 | 7/1973 | Drucker | 233/26 |
| 3,987,961 | 10/1976 | Sinn et al. | 233/27 |
| 4,032,066 | 6/1977 | Wright | 233/26 |
| 4,059,108 | 11/1977 | Latham, Jr. | 128/214 R |
| 4.098,456 | 7/1978 | Bayham | 494/21 |
| 4,119,407 | 10/1978 | Goldstein et al. | 422/58 |
| 4,135,883 | 1/1979 | McNeil et al. | 494/21 X |
| 4,266,717 | 5/1981 | Jennings et al. | 233/26 |

FOREIGN PATENT DOCUMENTS

| | | | |
|---|---|---|---|
| 149615 | 7/1981 | Fed. Rep. of Germany | 233/26 |

*Primary Examiner*—Robert W. Jenkins
*Attorney, Agent, or Firm*—R. J. Steinmeyer; F. L. Mehlhoff; A. A. Canzoneri

[57] ABSTRACT

A liner for use in a centrifuge rotor bucket for converting a single cavity bucket into a multicavity bucket to provide separate support for at least two flexible fluid sample containers. The liner has a separation ridge which defines at least two areas in the liner, but allows maximum space for receipt of the flexible containers. Handle means are attached to the liner to provide ease in the removal and insertion of the liner into the rotor bucket.

8 Claims, 5 Drawing Figures

ROTOR BUCKET LINER

BACKGROUND OF THE INVENTION

The present invention is directed to high speed centrifuge rotors and, more particularly, is directed to a liner for use in a swinging bucket type of centrifuge rotor for support of flexible bag containers holding fluid samples.

When blood is collected from a donor, it is normally received in a flexible bag type of container. This container is suitable for not only the collection of the blood, but also for the storage and maintenance of the blood prior to its subsequent use in helping a needy recipient. In many instances, diagnostic work done with blood requires the subjection of the blood to a centrifuge force field. Since it is a requirement that the blood not be transferred or in any way removed from the container in which it was collected for reasons of possible contamination, a centrifuge rotor with swinging buckets is typically used so that the flexible blood bag can be inserted into the bucket cavity. In some centrifuge rotor buckets, the size of the cavity is such that it will accept two or more blood bags. This is economically important because, if a particular centrifuge rotor has six buckets in which to place a blood bag and if the two blood bags can be inserted into each bucket, the capacity of the rotor is doubled and will result in the centrifugation of twice the number of samples for each centrifugation run.

However, it has been found that placing blood bags side by side in the rotor bucket cavity may result in the bags slipping or becoming improperly oriented within the bucket during centrifugation. Also, it has been found that it is sometimes difficult to insert the bags into the rotor bucket. This is exemplified by the considerable weight of the bucket which must be removed from the rotor yoke and placed on a table in order to conveniently insert the blood bags. In some instances, since the blood bags are typically made of a plastic type material, they are difficult to grasp and remove subsequent to the centrifugation run.

Also, these flexible thin plastic bags require that the interior of the swinging bucket be extremely smooth when it is made so that there is no chance of possible damage to the bags which would cause a leakage. Consequently, there is more machining cost involved making sure that the interior of the forged swinging bucket is as smooth as required. In some instances, the bag may be damaged when during centrifugation the bag is forced against a sharp interior bottom/wall junction or corner where the bag material is stretched too far, causing a tear in the bag.

In some instances there may be a defect in the blood bag which may result in leakage during the operation of the centrifuge. Consequently, it is necessary subsequent to the centrifugation run to clean the interior of the bucket. Since the buckets are relatively heavy and cause some difficulty in properly cleaning them, an unwarranted amount of time can be spent doing this necessary cleaning operation.

SUMMARY OF THE INVENTION

The present invention utilizes the placement of a thin, but structurally inherent liner in a centrifuge rotor bucket. The liner is designed in such a manner that its interior has a separation ridge which extends from the top of one side of the liner down along to its bottom, across the bottom and up the other side of the liner so that it is divided into at least two distinct portions or areas. The separation ridge provides a restraining barrier between fluid sample bags placed within the liner, so that they will not become misaligned during centrifugation. It is important during centrifugation that the bags be aligned in a side-by-side orientation so that the same respective area of each bag is subjected to the approximate same centrifugal force field.

Further, the liner has handle means connected to it to promote ease of insertion and removal of the liner into the bucket. Since the liner is made of a plastic material, it is much lighter than the machined metal swinging bucket. Therefore, the liner provides a much easier item within which to work for the placement and removal of blood bags into the rotor bucket.

The use of a molded plastic liner provides for a smooth internal surface to receive the bag and eliminates the need for providing extremely smooth interior surface in the swinging bucket itself, reducing the cost of machining the swinging bucket. The liner also has a relatively large radius area where the wall and bottom join so that during centrifugation the bag is well supported without excessive stretching in any area of the bag.

The utilization of the present invention provides a liner which is easily removed and has a smooth contour that enhances the ability to properly clean it if a spill or leakage should occur during the centrifugation run. The lightness as well as the general smooth configuration of the liner enhances one's ability to clean the device subsequent to a leakage occurring.

DETAILED DESCRIPTION OF THE INVENTION

Figure 1:
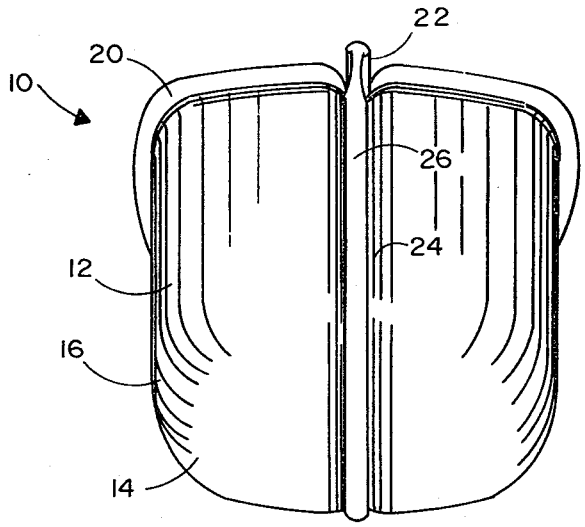
FIG. 1 is a perspective view of the rotor liner of the present invention showing the bottom and one side.
Figure 2:
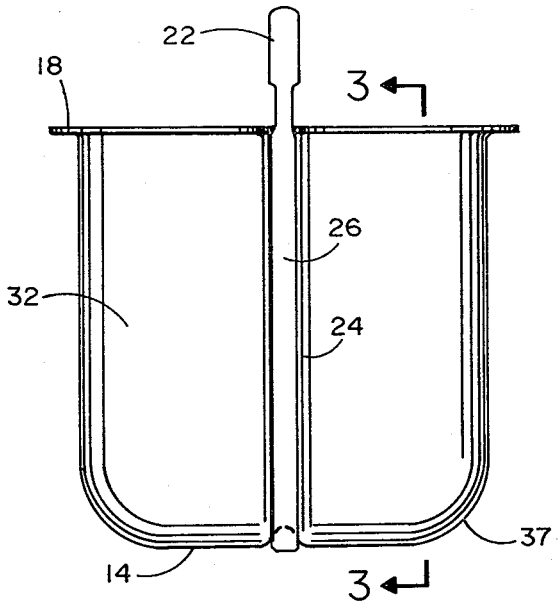
FIG. 2 is an elevational side view of the liner.

Attention is directed to FIGS. 1 and 2 showing a liner 10 for insertion into a swinging bucket type rotor. The liner has an elongated body portion 12 with a bottom 14 integrally formed at one end 16 of the body portion 12. Adjacent the other or top end 18 of the body portion 12 is an open end surrounded by a support flange 20. The liner is preferably made of a thin plastic material, but is structurally inherent to maintain its shape and strength when standing free of any support.

A handle 22 is mounted on the liner 10 adjacent its open end 18. Since the liner 10 is preferably molded, an indented channel 24 is molded into the elongated body portion 12 as well as in the integral bottom 14. The channel 24 extends in a longitudinal direction from the top end 18 of the liner down to and across the bottom 14 and up the opposite side of the liner to the top end 18. The channel 24 establishes an exterior indentation for receipt of a strap 26 that is integrally formed with the handle 22 and can be snapped into place within the channel 24 for securing the handle to the liner.

Figure 3:
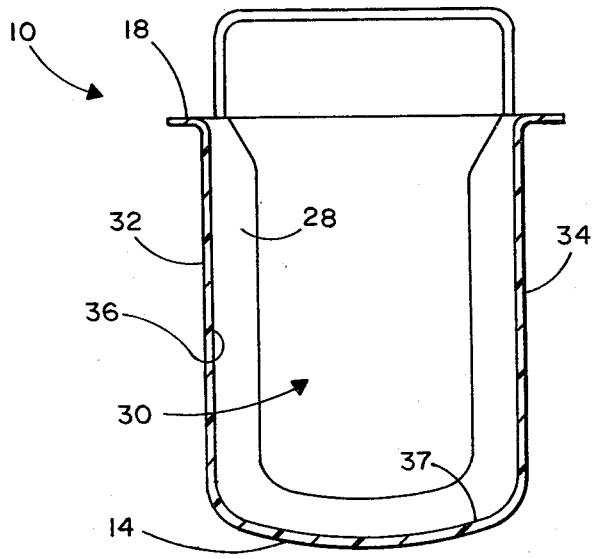
FIG. 3 is a sectional view taken along the line 3—3 of FIG. 2.

Concurrent with the formation of the channel 24 is the formation of a separation ridge 28 as shown in FIG. 3 within the interior 30 of the liner 10. The ridge 28 begins adjacent the upper end 18 of the liner and proceeds down one side of the side 32 of the container, across the bottom 14 and up the other side 34 to the upper end 18. The separation ridge 28 projects from the flat interior surface 36 of the interior 30 of the container. With respect to the liner shown in FIGS. 1 and 2, the separation ridge 28 of FIG. 3 divides the liner into at least two areas or portions for the receipt of flexible fluid sample carrying bags.

Figure 4:
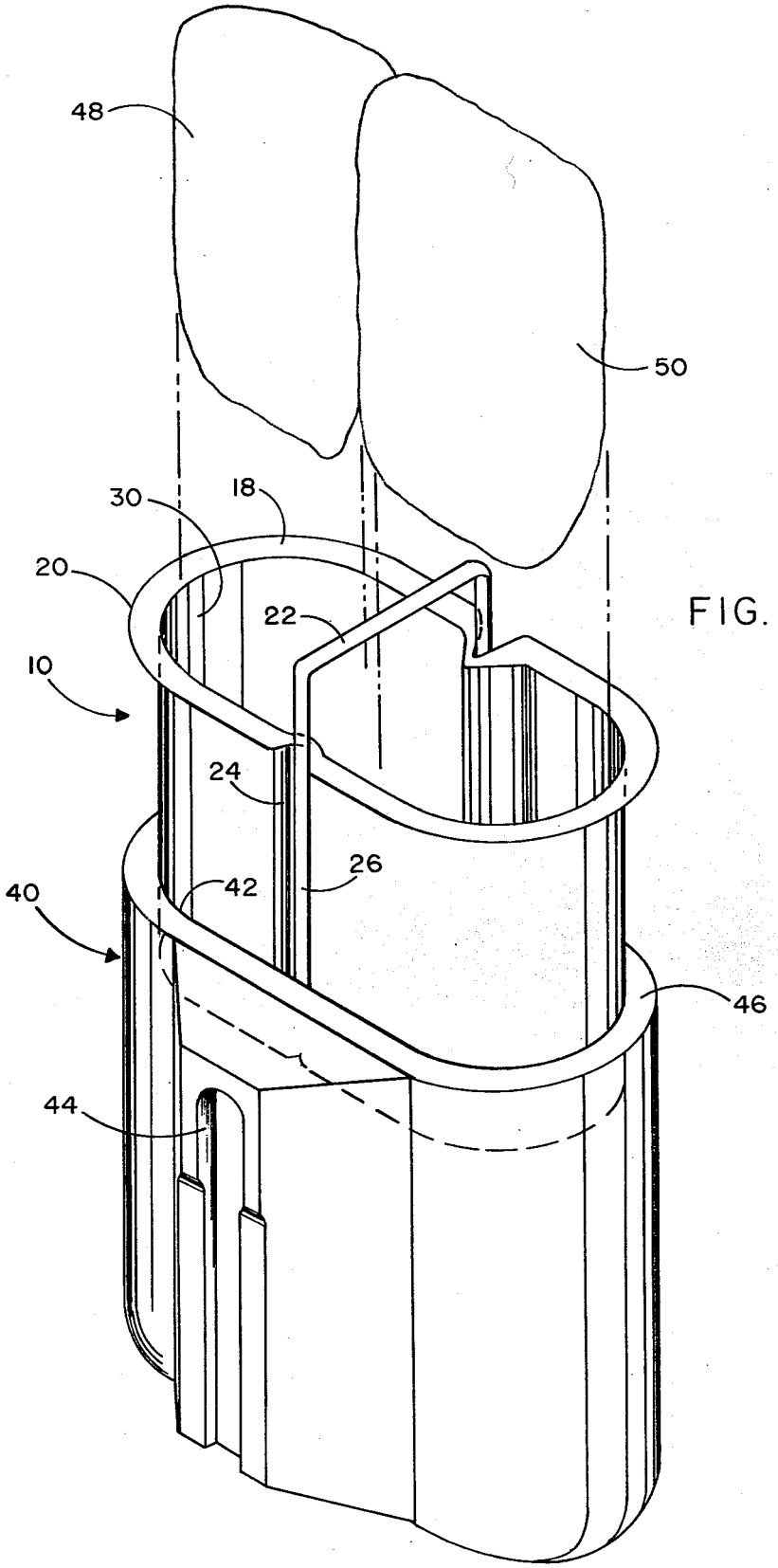
FIG. 4 is a perspective view of the rotor bucket with the liner partially inserted and two flexible sample bags for insertion into the liner.

Attention is directed to FIG. 4 showing a rotor bucket 40 having an interior cavity 42 for receipt of the liner 10. The rotor bucket 40 has a pair of rotor hinge pockets 44 which are designed to receive rotor pins from the rotor as will be explained. The liner 10 is shown partially inserted into the cavity 42 of the bucket 40. When the liner 10 is completely inserted into the rotor bucket 40, the support flange 20 will rest on the top ledge 46 of the rotor bucket. In addition, the exterior of the liner 10 is designed to mate and conform with the complete interior configuration of the cavity 42 in the bucket, so that there is complete external support for the liner provided by the interior of the rotor bucket 40. The interior 30 of the liner 10 is designed to receive at least two flexible sample-containing bags 48 and 50.

It should be noted that the interior of the liner 10 in FIG. 3 has a relatively large radius 37 at the side 32/bottom 14 junction area to provide contoured support for the flexible fluid sample carrying bags 48 and 50 to enhance higher centrifugal speeds and better sample processing. The large radius 37 at the bottom of the interior of the liner is designed to have substantially the same contour as th flexible fluid sample carrying bags 48 and 50 such as blood bags. As stated previously, this similar contoured shape provides a contoured support to the bag. If the radius 37 were very small or relatively sharp, the sample carrying bag may be forced tightly into the small radius junction during centrifugation and create stress on the bag which in some instances may cause a rupture in the bag.

Figure 5:
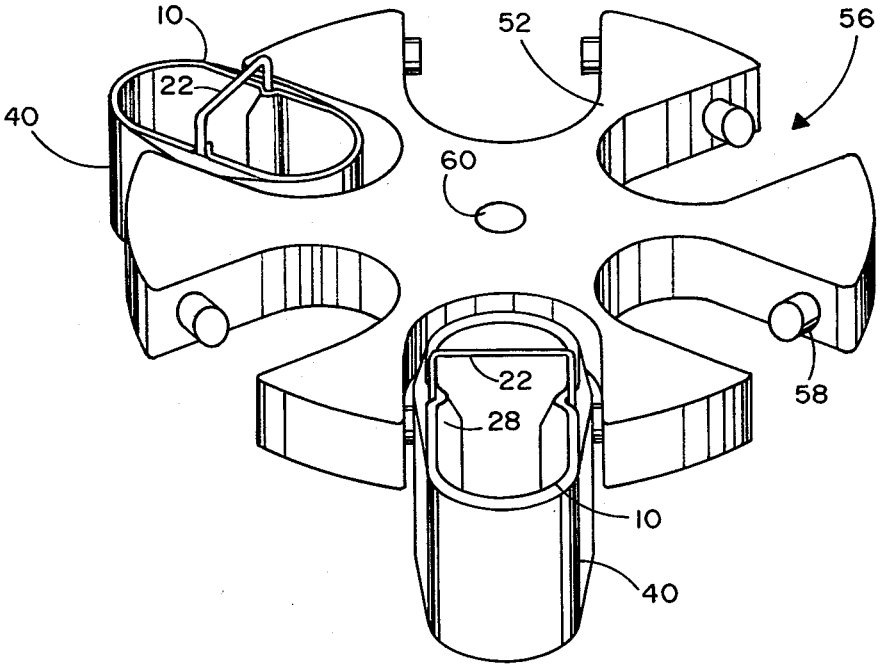
FIG. 5 is a perspective view of a rotor yoke with two swinging buckets having liners.

In FIG. 5, a rotor yoke 52 is shown having a plurality of rotor yoke arms 54 which form yoke areas 56 for receipt of a swinging bucket 40 which is designed to interface with and pivot on support pins 58. The hinge pin pockets 44 of the rotor bucket 40 receive the support pins 58 as shown in FIG. 4. The rotor yoke 52 is designed to rotate about the rotor axis 60 and is driven by a centrifuge mechanism which is not shown. For the sake of simplicity, only two rotor buckets 40 are shown connected to the rotor.

When using the present invention, the rotor liner 10 is placed on a work bench where the operator inserts at least two flexible bags such as blood bags 48 and 50 of FIG. 4. The bags are oriented in a particular manner so that the same respective areas in the bags will be subjected to the same centrifugal force field generated by the centrifuge. The separation ridge 28 maintains the proper orientation of the bags 48 and 50 with respect to each other during centrifugation. Without the projecting ridge, the bags 48 and 50 may tend to reorient and slip one under the other. This is not desirable, since it would result in one bag being further from the rotor spin axis than the other bag, resulting in one bag experiencing more centrifugal force than the other.

Once the bags are properly inserted into the liner 10, the operator grasps the handle 22 and carries the flexible bags to the rotor for insertion into the cavity 42 of the bucket 40. The liner is slid completely into the cavity 42, so that the support flange 20 is resting tightly against the ledge 46 of the bucket. After all of the buckets have been evenly balanced in the rotor, the centrifuge machine will be started and the rotor, as shown in FIG. 5, will spin about the spin axis 60, causing the buckets to pivot on the hinge pin 58 to orient the bottom 41 of the bucket parallel to the spin axis 60. The bags will be subjected to a force field essentially perpendicular to the spin axis 60.

After the completion of the centrifugation run, the swinging buckets 40 again return to their vertical orientation as shown in FIG. 5, allowing the individual to grasp the handle 22 of the liner 10 and remove the liner with the blood bags for placement on the work table for easier removal of the bags after the centrifugation run. When the liners are removed from the centrifuge buckets, it is possible to have new liners ready with new bags for subjection to centrifugation so that the centrifuge can be quickly put into operation again, eliminating a lot of wasted time which would otherwise occur when trying to remove the bags directly from the swinging bucket and subsequent insertion of the bags directly into the rotor bucket.

What is claimed is:

1. In a centrifuge rotor for operation in a centrifuge, a combination comprising:

a swinging bucket attached to said rotor;

a thin-walled liner mounted in said bucket, said liner having an interior cavity for holding at least two flexible fluid sample holding bags;

a channel indented along the exterior sides and the bottom of said liner forming a protrusion in the interior of said liner defining a separation ridge therein;

said separation ridge dividing said liner cavity into two compartments, each adapted for receiving one of said sampleholding bags;

a handle attached to said liner for removing said liner from said bucket, said handle having an integral strap configured to snap into said channel of said liner; and said liner having an outside flange at the upper periphery of said cavity of said liner.

2. A liner for use in the cavity of a bucket of a swinging bucket rotor in a centrifuge, said liner being adapted for holding a pair of sample bags, said rotor having at least two buckets mounted thereon, said rotor being adapted for rotating about the spin axis of the centrifuge, comprising:

a thin-walled liner body formed in the shape of said bucket cavity defining wall and bottom surfaces in said liner body;

a separation ridge formed on the interior side of said wall and bottom surfaces of said liner body;

said separation ridge being disposed in a plane radial of said spin axis;

said separation ridge dividing the interior of said body into two compartments, each being adapted for holding one of said sample bags.

3. The liner defined in claim 2 wherein said separation ridge is formed in the interior side of said liner body by an indented channel formed in the exterior side of said wall and bottom surfaces.

4. The liner defined in claim 3 further including a handle attached to said body for removing said liner from said bucket and for carrying said liner, said handle including a strap integrally formed therewith, said strap being dimensioned so as to snap into said indented channel of said liner body and be removably retained therein.

5. The liner defined in claim 2 further including an outer flange encircling the upper periphery of said wall surface of said liner body.

6. In combination with a swinging bucket of a rotor in a centrifuge, a bucket liner adapted for holding a plurality of sample bags, comprising:

a rotor rotatable about a spin axis;

a bucket adapted for mounting in said rotor;

a liner disposed in said bucket, said liner having relatively thin walls generally conforming to the interior shape of said bucket, thereby forming a cavity in said liner;

a channel indentation in the exterior walls of said liner, said channel extending longitudinally down the sides of said liner and transversely across the bottom of said liner;

said channel indentation on said exterior walls of said liner forming a protrusion defining a separation ridge on the interior walls of said liner;

said separation ridge being disposed in a plane radial of said spin axis;

said separation ridge dividing said cavity of said liner into two compartments, each adapted for holding a sample bag.

7. The combination defined by claim 6 wherein said liner includes an outer peripheral flange at the upper end of said liner cavity.

8. The combination defined by claims 6 or 7 further including a handle, said handle comprising a narrow strap formed into a continuous loop and adapted for being captively disposed in said channel indentation of said liner.

* * * * *